United States Patent [19]

Stafford

[11] Patent Number: 4,793,276

[45] Date of Patent: Dec. 27, 1988

[54] ANCHOR

[76] Inventor: Edward Stafford, 322 Englewood Dr., Crawfordsville, Ind. 47933

[21] Appl. No.: 921,758

[22] Filed: Oct. 22, 1986

[51] Int. Cl.[4] ..... B63B 21/26

[52] U.S. Cl. ..... 114/300; 114/301

[58] Field of Search ..... 114/300, 301, 294

[56] References Cited

U.S. PATENT DOCUMENTS

| | | | |
|---|---|---|---|
| 677,839 | 7/1901 | Young | 114/300 |
| 1,319,419 | 10/1919 | Reynolds | 114/206 |
| 1,494,545 | 5/1924 | Holzapfel | 114/301 |
| 1,613,107 | 1/1927 | Holzapfel | 114/301 |
| 2,111,443 | 3/1938 | Windle | 114/300 |
| 2,239,889 | 4/1941 | Hobbs | 114/301 |
| 2,522,191 | 9/1950 | Pillow | 114/301 |
| 2,735,394 | 2/1956 | Walpole | 114/206 |
| 3,083,675 | 4/1963 | Rice | 114/300 |
| 3,158,127 | 11/1964 | Gallaugher | 114/206 |
| 3,402,689 | 9/1968 | James, Jr. et al. | 114/206 |
| 3,754,524 | 8/1973 | Locks | 114/206 R |
| 4,383,493 | 5/1983 | Takamatsu et al. | 114/294 |

FOREIGN PATENT DOCUMENTS

| | | | |
|---|---|---|---|
| 965800 | 10/1982 | U.S.S.R. | 114/301 |

*Primary Examiner*—Joseph F. Peters, Jr.
*Assistant Examiner*—Clifford T. Bartz
*Attorney, Agent, or Firm*—Woodard, Emhardt, Naughton, Moriarty & McNett

[57] ABSTRACT

An anchor with a shaft and a head portion made of high density lead and having a plurality of flukes extending radially from the head portion.

16 Claims, 2 Drawing Sheets

ANCHOR

BACKGROUND OF THE INVENTION

This invention relates to an improved anchor with a plurality of flukes to aid in securing a boat to a position in a body of water.

Various anchors are disclosed by the following group of patent references. The following references are believed to be the most relevant art relating to the present invention, though some references are believed to be more relevant to the present invention than others.

| PATENT NO. | PATENTEE |
|---|---|
| 1,319,419 | Reynolds |
| 3,158,127 | Gallaugher |
| 3,402,689 | James |
| 4,383,493 | Takamatsu |
| 2,735,394 | Walpole |
| 3,754,524 | Locks |

Reynolds discloses an anchor having a concave bottom surface, a shank and a plurality of flukes for engaging the bottom surface of the lake. Reynolds does not disclose a substantially planar seating portion for engaging the flat bottom of a body of water. Additionally, since Reynolds does not disclose a convex top surface, the Reynolds anchor would collect debris in the bowl-shape of its head portion which would increase the effort required to retrieve the anchor from the bottom of a body of water.

Gallaugher discloses an anchor with a convex bottom surface, a substantially planar seating portion, and a shank, all of which are coated with plastic. Gallaugher, however, does not have a convex top surface to the head portion and thus suffers from the same inefficiency as the Reynolds anchor. Additionally, the Gallaugher anchor envisions filling the plastic outer shell of the anchor with sand or an equivalent heavy media which can be dumped or emptied at will, and therefore does not envision the use of high density iron with a vinyl coating therearound.

James discloses a two-piece anchor with a convex bottom surface and a substantially planar seating portion as well as a frusto-conical shank portion. James anchor does not disclose a convex top surface to the head portion, but rather relies on flowthrough ports in the head portion to remove debris from the head portion. Additionally, James relies upon the dish-shape of the head portion as a single fluke extending completely around the anchor and thus would require that the anchor be tipped at a substantial angle in order for the flukes to dig into the bottom of a body of water.

Takamatsu discloses an anchor with a substantially planar seating surface and a convex top surface.

Walpole discloses an anchor with a substantially planar seating surface designated with a fluke extending downwardly at right angles to the seating surface to engage the bottom of a body of water.

Locks discloses a plastic coated iron anchor with a substantially planar seating surface. The Locks anchor requires that the anchor reach a substantial degree of inclination before the ring 12 disposed thereabout begins to dig into the bottom of a body of water and thereby help to hold the boat in position.

SUMMARY OF THE INVENTION

One embodiment of the present invention is an anchor with a frusto-conical shank portion attached to a head portion that has a convex top surface and a convex bottom surface. The shank portion and the head portion alone resemble generally what is known as a mushroom type anchor. The head portion has a substantially circular peripheral edge which is defined by the meeting points of the convex top surface and the convex bottom surface. In the center of the convex bottom surface is a substantially planar seating surface. Attached to the peripheral edge and extending radially from that edge are a plurality of prow-shaped flukes which form points for digging into the bottom surface of the lake. Means for attachment of the anchor to a cable attached to a boat is provided by an eye which is connected to the top of the frusto-conical shank portion. The flukes, head portion, and shank are all manufactured of high density lead which is covered with a vinyl coating. The anchor is designed so that it can be manufactured with a simple two-piece split mold. One object of the present invention is to provide an anchor that provides additional holding power under most conditions without carrying unnecessary weight.

Another object of the present invention is to provide an anchor with the weight of pure lead combined with flukes or points that quickly dig into the bottom surface of a body of water to prevent drifting of the boat.

Yet another object of the invention is to provide an anchor which has increased holding power that is designed to inhibit rolling of the anchor in swift water.

Yet another object of the present invention is to provide an anchor that will shed water and mud as it is retrieved to the boat from which it was dispatched.

Another object of the present invention is to provide a vinyl coated anchor which eliminates cuts and bruises while protecting the boat by shedding water and mud.

Related objects and advantages of the present invention will be apparent from the following description.

DESCRIPTION OF THE PREFERRED EMBODIMENT

Figure 2:
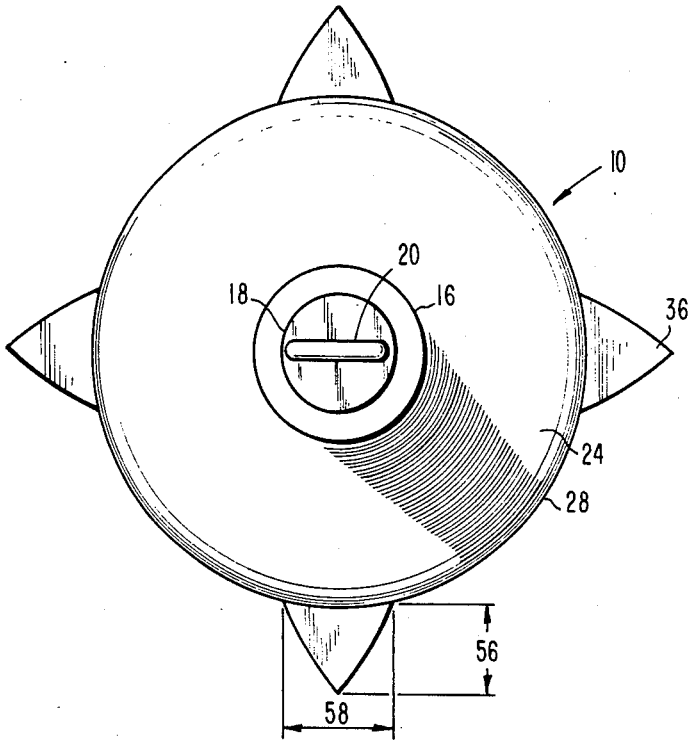
FIG. 2 is a top view of the improved anchor.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illutrated device, and such further applications of the principles of the invention as illustrated therein being contemplated as would normally occur to one skilled in the art to which the invention relates.

Figure 1:
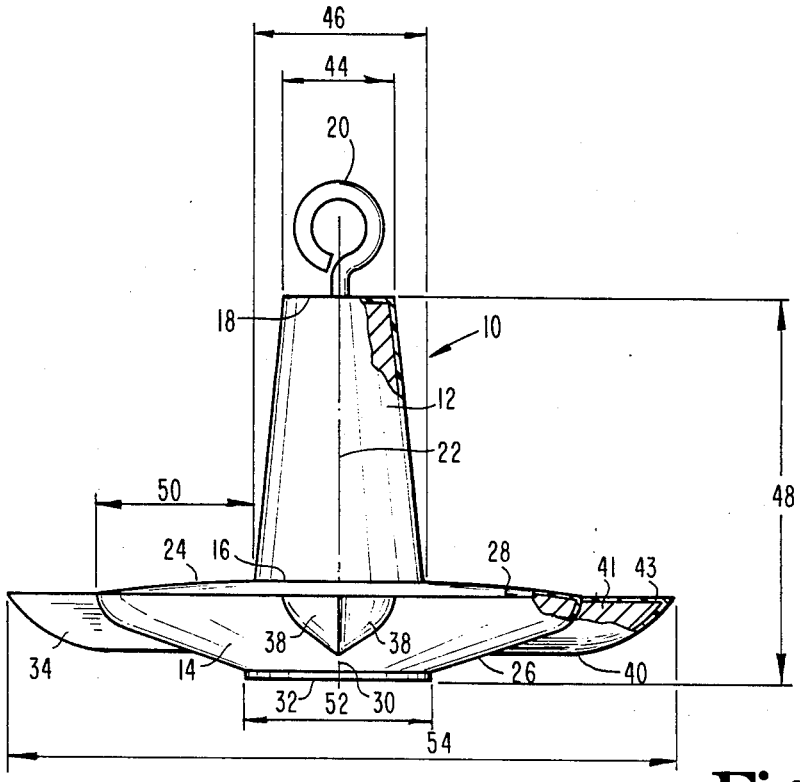
FIG. 1 is a side elevation partial cross-sectional view of the disclosed improved anchor.
Figure 3:
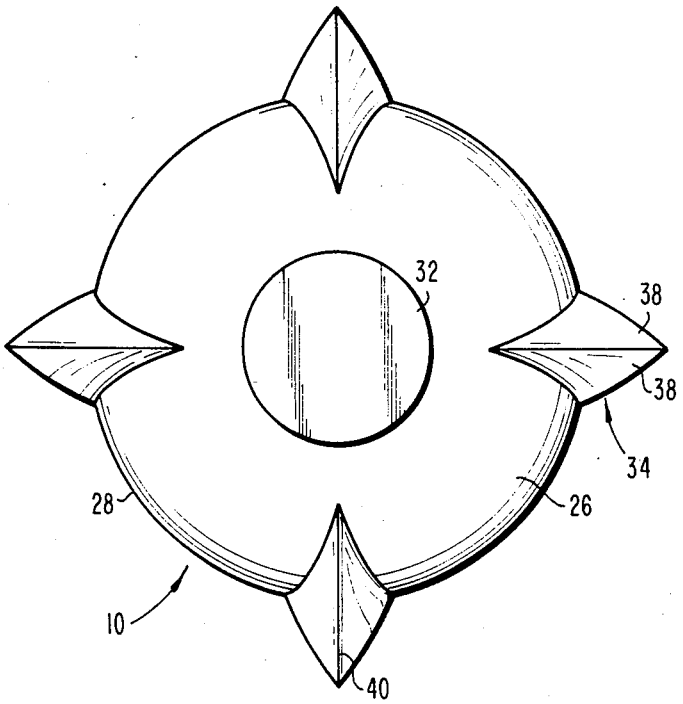
FIG. 3 is a bottom view of the improved anchor.

Referring more particularly to FIG. 1, there is illustrated an anchor 10 according to the present invention. The anchor 10 consists of a shank portion 12 and a head portion 14. As can be seen from FIGS. 1 and 2, the shank portion 12 is frusto-conical in shape, having its wide end 16 attached to the head portion 14. The narrow end 18 of the shank portion 12 has a connection means 20 attached thereto. The connection means 20 illustrated in the drawings is an eyebolt inserted into the narrow end of the shank portion. It is envisioned that this eyebolt may be made of zinc to inhibit corrosion of the connection means. Also the shank portion 12 is concentric about a longitudinal axis 22.

The head portion 14 has a convex top surface 24 and a convex bottom surface 26. The convex top surface 24 and the convex bottom surface 26 intersect to define a substantially circular peripheral edge 28. The circular peripheral edge 28 is concentric about an axis 30. Axis 30 of the head portion and longitudinal axis 22 of the shank portion are collinear in the construction of improved anchor 10. The substantially planar seating surface 32 is attached to the convex bottom surface 26. The substantially planar seating surface 32 is illustrated to be generally circular with the substantially planar seating surface 32 being concentric about axis 30. Extending radially from peripheral edge 28 is a plurality of flukes 34 or points. These flukes have a planar v-shaped top surface 36 with the wider part of the v-shaped surface attaching to the peripheral edge 28. Extending downwardly from the sides of the v-shaped top surface 36 are side surfaces 38. The v-shaped top surface 36 and side surfaces 38 combine to form a fluke with the outward appearance of the prow of a v-hulled boat. Side surfaces 38 intersect from the bottom 40 of the fluke. The bottom 40 of the fluke is displaced from a hard surface as the anchor 10 sits upright on a hard surface.

As can be seen from FIG. 1, the shank portions 12, head portion 14, and flukes 34 are all constructed of high density lead 41 and have a vinyl coating 43 disposed on them. The vinyl coating 43 reduces scrapes and cuts to the boat from contact with the anchor and also helps the anchor to shed water and mud as it is being retrieved from the bottom of a body of water.

A description of the use of the improved anchor 10 will aid in the understanding of the purpose of the specific elements described above. The anchor is attached to a cable or a rope and is lowered from a boat until it touches the bottom surface of a body of water, herein a lake. Lake bottoms come in a variety of surfaces such as muck, sand, shale, rocks, gravel or stone. When the anchor contacts the bottom of a smooth level surface, the anchor will initially seat in a substantially planar seating surface 32. As the boat begins to drift somewhat, a tug on the rope connected to the connection means 20 will cause the anchor to tilt. The convex bottom surface is designed so that as the anchor tilts approximately 20% from vertical, the flukes or points 34 of the improved anchor 10 begin to dig into the bottom surface of the lake. The illustrated anchor has two pairs of flukes 34 with each member of a pair being diametrically opposed on the peripheral edge from the opposite member of the pair, and each pair being in a rectilinear relationship to the other pair. This allows two of the flukes to be able to engage the bottom surface of the lake at any time. As the anchor tips, the prow-shape of the fluke will cause the anchor to rotate about the longitudinal axis 22 so that two flukes will engage the bottom simultaneously and therefore increase the digging power of the anchor. Additionally, the peripheral edge will dig into the bottom of a lake to a certain extent at it is somewhat v-shaped.

On a mucky or muddy surface, not only will the substantially planar seating surface engage the bottom of the lake but also since the anchor will sink into the surface, the bottom 40 of the flukes 34 and the convex bottom surface 26 will engage the bottom of the lake. After digging into the bottom of the lake, muck or mud or sand cover the convex top surface 24 of the anchor. In a typical mushroom type anchor, when the anchor is retrieved this muck or mud remains entrapped in the anchor and must be manually cleaned off before the anchor is retrieved into the boat in order to prevent getting the boat dirty. In the present invention, as the anchor is retrieved the convex top surface sheds the mud or muck as it is being drawn through the water upon retrieval. Improved anchor 10 has no bowls to capture mud or muck as in previous mushroom anchors.

The eye used as connection means 20 may be zinc plated in order to prevent corrosion. The eye may be an eyebolt that is molded directly into the anchor or subsequently screwed into the frusto-conical shank portion after the anchor is manufactured.

As can be seen from the drawings, the shank portion, head portion and flukes, as well as the substantially planar seating surface can be molded as a single unit. A simple two-piece split type mold which splits along the longitudinal axis 22 could be used as well as a mold that splits at the convex top surface 24. Thus the symmetry of this anchor aids in its manufacture.

It is envisioned that the disclosed anchor 10 may be made in various sizes to accommodate the size of the boat which is to be anchored. Dimensions will be disclosed herein in the units with the understanding that as the weight of the anchor increases, the size of the units must also increase. From the top of the shank portion to the bottom of the substantially planar seating surface is five units 48. The substantially planar seating surface has a diameter of 2.5 units 52. The distance between points of diametrically disposed flukes is 8.88 units 54. The top of the shank portion has a diameter of 1.5 units 44, while the bottom of the shank portion has a diameter of 2.25 units 46, thereby defining the frusto-conical shape of the shank portion. From the edge of the shank portion to the peripheral edge is approximately 2.13 units 50, which reveals that the diameter of the circular peripheral edge is 6.71 units. The flukes are 1.5 units 58 in width of the widest point of the v-shaped top surface where they attach to the peripheral edge. From the peripheral edge to the point of the v-shaped top surface is 1.25 units 56. The disclosed dimensions ensure that the disclosed anchor will easily fit snugly into an anchormate bracket, which is a common bracket used in the boating industry.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An improved anchor for securing a floating object to the bottom of a body of water comprising:

a head portion having a convex top surface, a convex bottom surface interfacing at an acute angle with said convex top surface to define a substantially circular peripheral edge, a substantially planar seating surface attached to said convex bottom surface;

a shank portion extending at an obtuse angle from said convex top surface of said head portion;

a plurality of flukes extending radially from said peripheral edge;

a rope attachment means fixedly attached to said shank portion for attaching a rope or cable thereto;

wherein said shank portion, head portion and flukes are manufactured of high density lead.

2. The anchor of claim 1 wherein said shank portion is frusto-conical, said shank portion tapering from wide to narrow as the distance from said head portion increases.

3. The anchor of claim 1 wherein said flukes comprise:

a v-shaped substantially planar top surface with the wider portion of said v-shaped surface smoothly joining with said convex top surface at said peripheral edge;

a pair of surfaces extending from opposite sides of said planar top surface to form a prow-shape which has a bottom that does not extend below said seating surface.

4. The anchor of claim 1 wherein said shank portion, head portion and flukes are completely coated with a vinyl coating.

5. The anchor of claim 3 wherein said shank portion is frusto-conical, said shank portion tapering from wide to narrow as the distance from said head portion increases.

6. The anchor of claim 4 wherein said shank protion is frusto-conical, said shank portion tapering from wide to narrow as the distance from said head portion increases.

7. The anchor of claim 5 wherein said substantially circular peripheral edge and said flukes are arranged relative to each other to allow said substantially circular peripheral edge and said flukes to coact to allow said peripheral edge to turn until two of said flukes and the peripheral edge contact the bottom of the body of water thereby providing three points of contact to secure the anchor when the anchor is not seated on said substantially planar seating surface.

8. An improved anchor comprising:

a head portion having a substantially circular peripheral edge, a first axis passing through the focus of said circular peripheral edge at right angles to a plane defined by said peripheral edge, a convex top surface symmetrical about said first axis, a rounded convex bottom surface symmetrical about said first axis, said convex top surface and said convex bottom surface intersecting at an acute angle to define said peripheral edge, a substantially planar seating surface connected to said convex bottom surface and symmetrical about said first axis;

a frusto-conical shank portion having a longitudinal axis, said shank portion being fixedly attached to the convex top surface of said head portion so that said longitudinal axis and said first axis are coincident and so that a frusto-conical surface of said shank portion extends at an obtuse angle from said convex top surface, said shank portion tapering from wide to narrow as the distance from said head portion increases;

a plurality of flukes extending radially from said peripheral edge;

an attachment means fixedly attached to said shank portion for attachment to a line from a boat to thereby anchor the boat;

wherein said shank portion, head portion and flukes are manufactured of high density lead.

9. The anchor of claim 8 wherein said shank portion, head portion and flukes are coated with a vinyl coating.

10. The anchor of claim 8 wherein said substantially planar seating surface is a projection of said frusto-conical shank portion through the head portion.

11. The anchor of claim 8 wherein said shank portion, head portion and flukes are symmetrical about a plane in which said first axis is contained.

12. The anchor of claim 8 wherein said flukes each have a planar v-shaped top surface and a pair of surfaces extending from the sides of the v-shaped top surface which connect to define a prow shape.

13. The anchor of claim 12 wherein said flukes attach to said peripheral edge at the widest point of said v-shaped top surface.

14. The anchor of claim 13 wherein there are four (4) flukes.

15. The anchor of claim 14 wherein said shank portion, head portion and flukes are coated with a vinyl coating.

16. The anchor of claim 1 wherein said substantially circular peripheral edge and said flukes are arranged relative to each other to allow said substantially circular peripheral edge and said flukes to coact to allow said peripheral edge to turn until two of said flukes and the peripheral edge contact the bottom of the body of water thereby providing three points of contact to secure the anchor when the anchor is not seated on said substantially planar seating surface.

* * * * *